United States Patent [19]

Brown

[11] 4,441,705

[45] Apr. 10, 1984

[54] EXERCISING APPARATUS

[76] Inventor: Lawrence G. Brown, 1629 Kuhilani St., Honolulu, Hi. 96821

[21] Appl. No.: 933,470

[22] Filed: Aug. 14, 1978

[51] Int. Cl.[3] ..... A63B 69/16

[52] U.S. Cl. ..... 272/73

[58] Field of Search ..... 272/73; 280/293, 295, 280/296; 211/17, 22; 128/25 R; 188/72.7

[56] References Cited

U.S. PATENT DOCUMENTS

| | | | |
|---|---|---|---|
| 351,311 | 10/1886 | Conkling | 272/73 |
| 589,705 | 9/1897 | Dwyer | 272/73 |
| 642,919 | 2/1900 | Nott | 272/73 |
| 2,140,731 | 12/1938 | Bendix | 188/72.7 X |
| 2,788,211 | 4/1957 | Ivanoff | 272/73 |
| 3,344,891 | 10/1967 | Thirion | 188/72.7 X |
| 3,432,164 | 3/1969 | Deeks | 272/73 |

FOREIGN PATENT DOCUMENTS

| | | | |
|---|---|---|---|
| 517774 | 2/1931 | Fed. Rep. of Germany | 272/73 |
| 779363 | 1/1935 | France | 272/73 |
| 100722 | 1/1941 | Sweden | 280/293 |
| 211031 | 2/1924 | United Kingdom | 272/73 |

*Primary Examiner*—Robert A. Hafer
*Assistant Examiner*—Arnold W. Kramer
*Attorney, Agent, or Firm*—Bruce G. Klaas

[57] ABSTRACT

Exercising apparatus for simulating the characteristics of exercise during actual riding of a bicycle comprising a stationary frame for mounting components of a bicycle or the like including at least a frame, a seat, handle bars and a front wheel fork, a rear wheel, crank arms and pedals, and a pedal operated drive system; a driven wheel for frictionally engaging the rear wheel for rotation by the rear wheel to simulate engagement with the ground during the actual riding of a bicycle; a fly wheel operatively connected to said driven wheel for energy storage during rotation of the rear wheel to simulate momentum during actual riding of a bicycle; and load applying resistance operatively connected to said driven wheel in the form of either a cage fan unit or a centrifugal control device for applying variable loads to said driven wheel to simulate variations in load encountered during actual riding of a bicycle.

12 Claims, 7 Drawing Figures

EXERCISING APPARATUS

BACKGROUND AND SUMMARY OF INVENTION

This invention relates generally to bicycle-type stationary exercise apparatus which involves the use of rotatable crank arms with pedals, such as used on bicycles, operably connected to a bicycle wheel subject to a variable load. Such apparatus has been known and used for many years in gymnasiums, health clubs and homes.

A primary object of the present invention is to provide new and improved bicycle type exercise apparatus which is capable of simulating the characteristics of exercise during the actual riding of a bicycle. Such characteristics of exercise during actual riding of a bicycle include, among other things, variations in wind resistance dependent upon the speed of the bicycle and riding conditions; variations in force of momentum dependent upon the speed of the bicycle and the weight of the rider; and variations in load dependent upon topography, i.e. uphill, downhill and level riding conditions. At the present time cycling has become a very popular sport for both recreational riders and for large numbers of racing and cross-country bicycling enthusiasts. Indeed, the health benefits of both actual bicycle riding and the use of stationary bicycle-type exercise apparatus have been long recognized by health authorities and the general public.

Some of the drawbacks of prior stationary bicycle-type exercise apparatus have included lack of similarity to actual bicycle riding conditions as well as relatively high cost of manufacture and bulkiness of the apparatus.

The apparatus of the present invention enables substantial duplication of actual bicycle riding conditions whereby the same body muscles are used in substantially the same way as doing actual bicycle riding. The duplication of actual bicycle riding conditions is of substantial benefit to all bicycle riders but is of particular importance to those bicycle riders who desire to train for particular bicycle riding situations such as for various kinds of bicycle racing and cross-country events. In addition, an important use of the present invention is as a rehabilitation exerciser device for physically handicapped persons. In this connection, the present invention enables smooth continuous uniform rotation and loading through each 360° crank shaft rotational cycle without the usual loss of momentum and velocity in the vertical crank arm positions of conventional bicycle type exercising apparatus.

The present invention enables the use of both (1) a self-contained exercise apparatus including permanently mounted bicycle-type parts; and (2) exercise apparatus which is adapted to employ portions of an actual bicycle thereby reducing cost and enabling use of bicycles already owned and actually used by the exerciser for bicycle riding. In the second form of the invention, the construction and arrangement of the exercise apparatus is such as to enable mounting of a conventional bicycle on the exercise apparatus by the simple expedient of removing the front wheel of the bicycle.

In both embodiments, the exercise apparatus comprises a stationary frame means in the form of an elongated tubular bottom member having laterally extending stabilizer members at the rear end thereof. An upwardly extending mounting post is provided at the front end of the bottom member to receive and support the front wheel fork of a bicycle. An upwardly extending central post is provided on the bottom member to receive and support the crank shaft hub portion of the bicycle. A rotatable driven friction wheel member is centrally mounted on a shaft member supported by mounting bracket members on a rear portion of the bottom member for frictional driven engagement with the rear wheel of the bicycle to apply load thereto simulating actual bicycle riding conditions. A flywheel device is mounted on one end of the shaft member to simulate momentum forces and an air resistance device is mounted on the other end of the shaft member to simulate air resistance forces. A variable load applying device is associated with the driven friction wheel member to simulate variable gravity and ground resistance forces encountered during actual bicycle riding.

DETAILED DESCRIPTION

Figure 1:
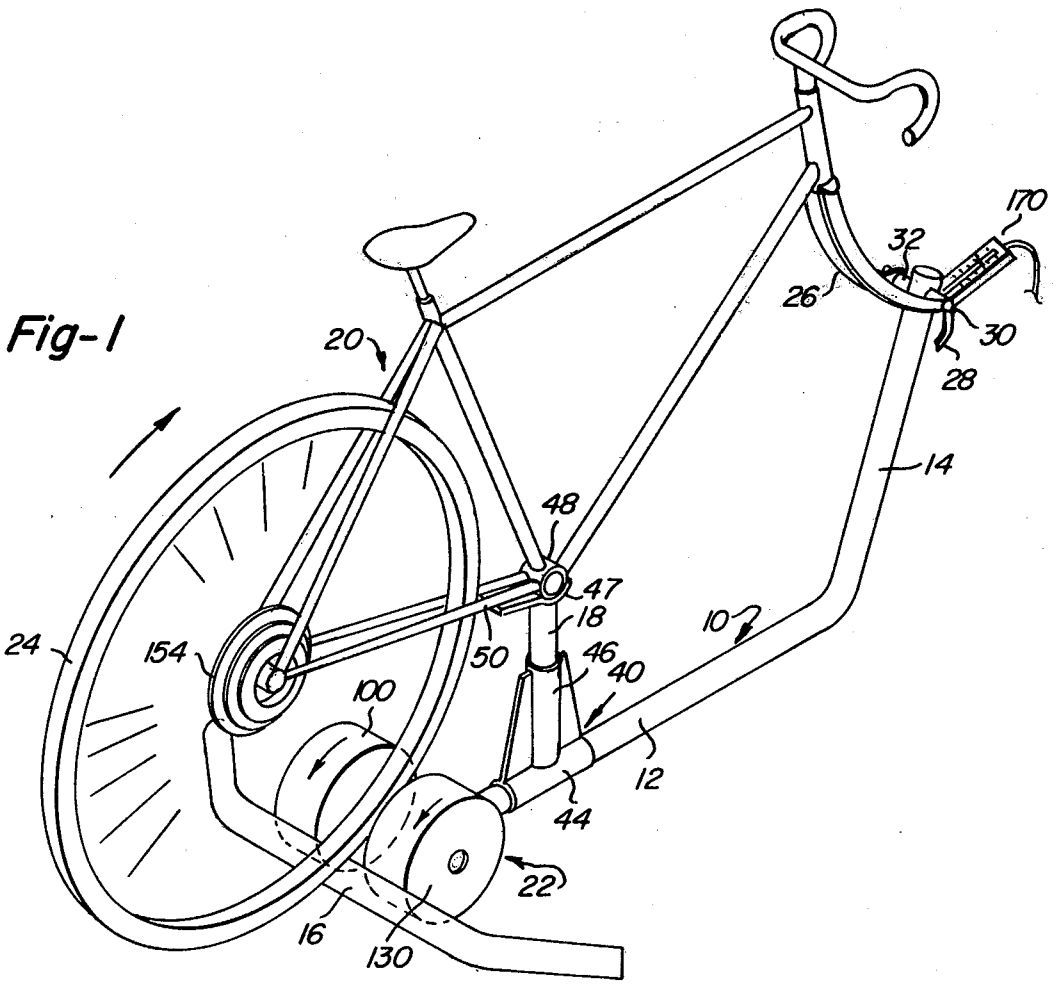
FIG. 1 is a schematic perspective view of one embodiment of the present invention showing an actual bicycle, with parts removed, mounted on the exercise apparatus of the present invention.

Referring to FIG. 1, in general, the exercise apparatus of the present invention comprises a stationary support frame means 10 having a main elongated horizontally extending bottom support member 12 with an upwardly extending front end support portion 14; a rear laterally extending stabilizer member 16; and a central upwardly extending support member 18 for supporting a bicycle 20, with the front wheel removed, in a vertical upright attitude. A variable load applying means 22 is mounted on the support member 12 of the support frame means 10 for driveable engagement with the rear wheel 24 of the bicycle 20.

The frame means 10 is preferably made of tubular metallic material such as steel or aluminum. The support member 12 and the stabilizer member 16 may be permanently fastened together as by welding or may be made as separable sections connected by threaded fasteners or the like to facilitate shipping and storage. The front end support portion 14 may be integral with the bottom member 12 as illustrated or may be a separate member suitably attached thereto by threaded fasteners or the like (not shown) for ease of shipping and storage. The size and shape of the front end support portion 14 is such as to receive and rigidly support the lower end of the fork 26 of a bicycle with the front wheel removed. A conventional quick release front wheel axle coupling 28 may be employed with a conventional front wheel axle member 30 or the like mounted in a support hub 32 and extending through aligned openings in the upper end of support portion 14. The central support member 18 is adjustably slidably mounted on the bottom member 12 by a bracket device 40 made of two half pieces secured by suitable threaded fastener devices 42 to provide a horizontal tubular portion 44 to receive bottom member 12 and a vertically extending tubular portion 46 to receive tubular member 18. A cradle member 47 is mounted on the top of the member 18 for engaging and supporting a conventional bicycle crank arm and shaft hub 48 with suitable bracket and threaded fastening devices 49 securely mounting the hub 48 on the cradle member 46 in association with the lower rearwardly extending bicycle frame members 50.

The variable load applying means 22 is slidably adjustably mounted on the bottom member 12 by suitable bracket members 60, 62 and threaded fastener devices 64, 66. The variable load applying means 22 comprises a main shaft member 68 rotatably supported by conventional bearing means 70, 72 mounted in hub portions 73, 74 in upwardly extending flange portions 75, 76 of the bracket member 60. A driven load applying wheel member 77, preferably having a high friction peripheral surface 78 of rubber-like material, is fastened to shaft member 68 and is frictionally drivably engageable with the rear wheel tire 79 of the bicycle. A pair of axially spaced guide flange members 80, 82 are mounted at the sides of the wheel member 77 to confine the rear bicycle wheel therebetween. Spacer sleeve members 84, 86 are mounted between the flange members 80, 82 and the bearing means 70, 72.

A fly wheel means 100 is fixedly mounted on one end of shaft member 68 for simulating the momentum forces encountered during actual bicycle riding. The flywheel means 100 of the preferred embodiment comprises a cylindrical member 102 of steel or the like having a suitable size and weight to effect the desired results. If desired, weight changing means (not shown) may be provided by suitable attachment devices on the cylindrical member 102 or the cylindrical member may be replaced by other cylindrical members of different sizes and weights.

Figure 4:
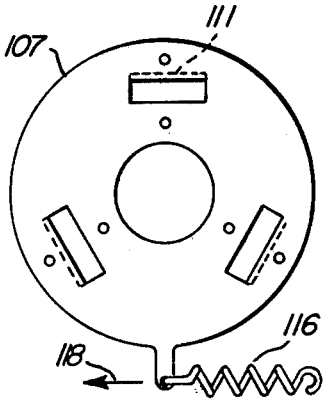
FIGS. 4 and 4*a* are a side elevational view and an enlarged cross-sectional view of a variable load applying device utilized with the exercise apparatus of FIGS. 1–3.
Figure 5:
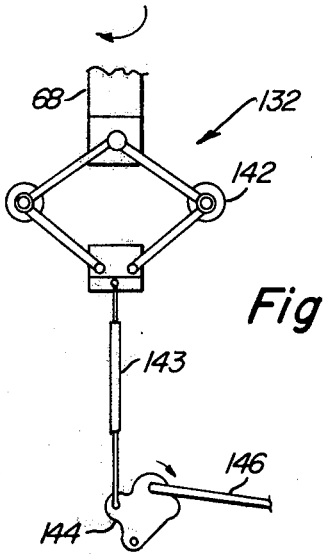
FIG. 5 is a side elevational view of a variable speed control device utilizable as an alternative embodiment with the apparatus of FIG. 4.
Figure 4A:
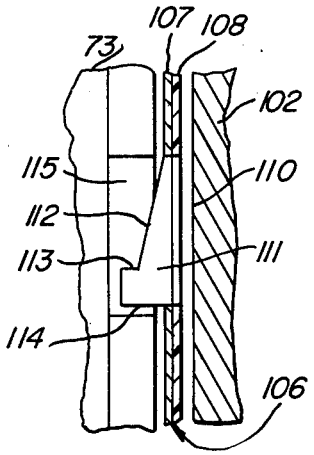

A first adjustable load motion retarding means 106, FIGS. 4 and 4*a* may be associated with the flywheel member or another portion of variable load applying means 22 on the bicycle wheel to enable adjustment of motion retarding force applied to the rear wheel of the bicycle. Means 106 comprises a disc-like frictional braking device 107, FIGS. 4 and 4*a*, mounted circumjacent shaft member 68 for limited axial and rotative displacement relative to the hub portion 73 to cause engagement of friction means 108, in the form of a lining or pads (not shown) with side surface 110 of member 102. Three laterally extending cam tab means 111, having inclined cam surfaces 112 and stop surfaces 113, 114 are located in corresponding notches 115 in hub portion 73 for variable adjustable loading against the bias of a return spring 116 by an adjustment device such as a cable 118 or the like.

The variable load applying means 22 further comprises speed responsive load control means 130, FIGS. 1–3, or 132, FIG. 5, for automatically increasing and decreasing the load applied to the driven wheel means in accordance with the rotational speed of the rear wheel.

Figure 2:
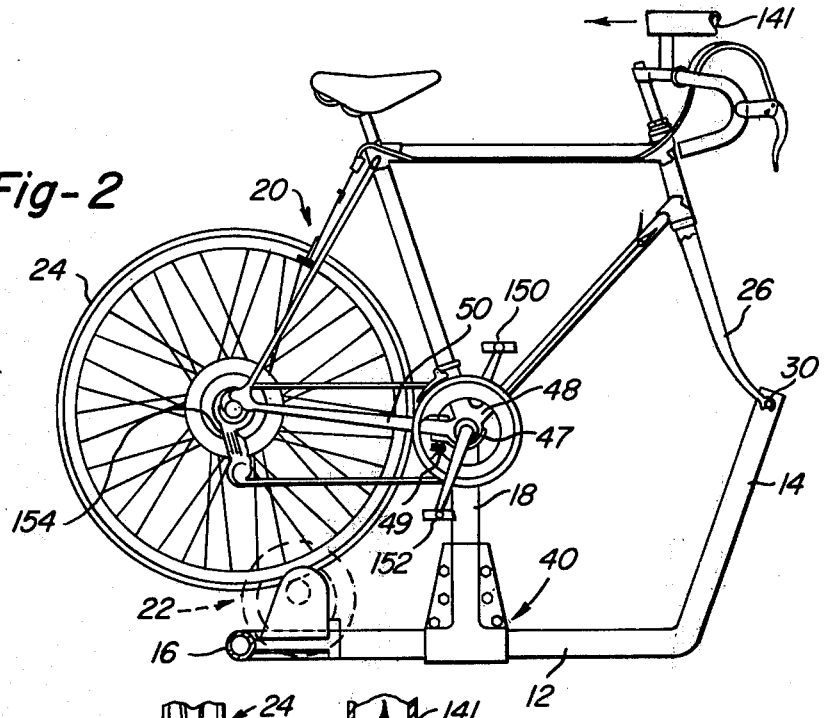
FIG. 2 is a side elevational view of the exercise apparatus of FIG. 1 with a bicycle mounted thereon in one position.
Figure 3:
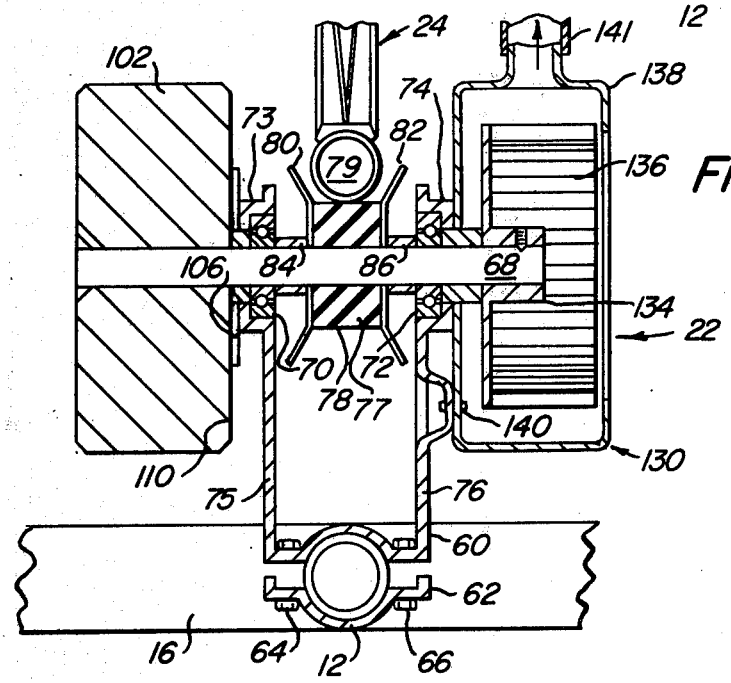
FIG. 3 is a cross-sectional view of a portion of the exercise apparatus of FIG. 1.

In the preferred embodiment of FIGS. 1–3, the load control means 130 comprises a conventional cage type rotary air blower member 134 fixedly mounted on the other end of shaft 168 opposite the flywheel means 100 with fan blade members 136 peripherally enclosed by a cylindrical housing member 138 fixedly mounted on flange portion 76 of bracket member 60 by suitable fastening means 140. The construction and arrangement is such as to provide restricted air flow through the blade members 136 so that the air resistance to rotation of the blower member 134 is proportional to the rotational speed thereof to simulate air resistance when actually riding a bicycle. In addition, if desired, a length of flexible tubing 141 may be connected to the air chamber in housing member 138 to provide a flow of air in front of the rider simulating the air flow during actual bicycle riding. The alternative speed responsive load control means 132 of FIG. 5 comprises a conventional centrifugal control device 142 rotatable by shaft 68 to cause variable linear displacement of a control member 143 proportional to rotational speed. Control member 143 may be suitably operatively connected to braking device 107 through a pivotal connecting member 144 and a cable member 146.

In operation, a conventional bicycle may be mounted on the exercise apparatus by the simple expedient of removing the front wheel of the bicycle and mounting the bicycle in the manner previously described with such adjustments in the adjustable mounting devices as may be necessary to accommodate different makes and sizes of bicycles. When the bicycle is properly mounted, the rear tire 79 of the bicycle frictionally drivably engages the outer periphery 78 of the driven wheel member 77. When the bicycle is ridden, i.e. the foot pedals and crank arms 150, 152 are rotated, any conventional bicycle drive system 154 is operated to cause rotation of the rear bicycle wheel of the bicycle and rotation of the driven wheel member 77. The frictional retarding force applied by the driven wheel member to the rear bicycle wheel is proportional to the effect of the various load variation devices associated with the main shaft member 68. The flywheel means 100 simulates momentum forces. The variable motion retarding force applying means 106 enables simulation of uphill, downhill or flat riding conditions as well as any other load conditions desired by the rider. The air resistance loading means 130 provides a resistance force which is directly proportional to bicycle speed to simulate air resistance during actual bicycle riding. In addition, if the centrifugal control device 142 is utilized in connection with the brake means 107, the retarding force is automatically controlled in direct relationship to speed of rotation of the rear wheel.

Figure 6:
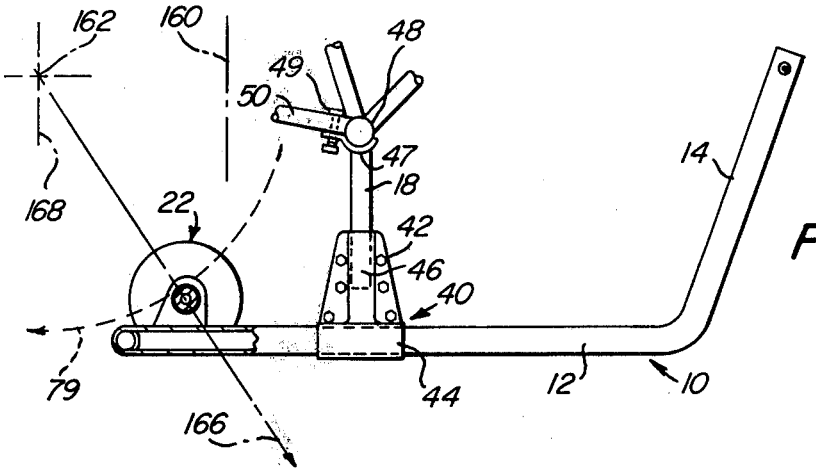
FIG. 6 is a partial side elevational view of the exercise apparatus of FIGS. 1–4 with a portion of bicycle apparatus mounted thereon in a preferred position.

As illustrated in FIGS. 1 and 6, the construction and arrangement is such as to require minimum space with maximum stability in use. The variable load applying means 22 is located between the rear wheel 24 and the hub 47 so that none of the exercise apparatus is located rearwardly of the rear wheel axis of the bicycle. In addition, the forwardmost portion of the exercise apparatus terminates at the front wheel axle mounting position. Not only is the length of the exercise apparatus less than the length of the bicycle, the height of the exercise apparatus is minimized with only slightly more clearance than that required for rotation of the rear wheel and pedal and crank arms being provided. In the preferred embodiment, as illustrated in FIG. 6, the lowermost portion of the rear wheel 79 of the bicycle is located in a plane substantially coplanar with the uppermost surface of the lower support member 12 which may be made of 2 inch diameter tubing material. Thus, the bicycle is mounted within approximately 2 inches or less of the normal ground engaging position during actual bicycle riding.

Maximum stability with minimum size and weight has been achieved by locating the variable load applying means 22 in relatively close proximity to a vertical plane 160 extending below the bicycle seat so that the center of gravity of the bicycle and the rider are in relatively close proximity to the variable load applying means. Thus, the stabilizer member 16 may be of relatively short length and located forwardly of the axis of rotation 162 of the rear wheel in relatively close proximity to the plane 160 of the bicycle seat between the rear wheel axis and the crank hub 48. The shape of the stabilizer member 16 may be varied as necessary or desirable and may include forwardly extending end portions, illustrated in FIG. 1, located in relatively close proximity to a vertical plane including the center of gravity adjacent the bicycle seat. The location of the variable load applying means 22 is such that the weight thereof, approximately 25 pounds, in the present preferred embodiment, is effective to provide maximum stabilization and the weight of the frame means 10 may be as low as approximately 10 pounds with use of aluminum tubular material as is presently preferred. Also, the location of the flywheel means 100 and the speed responsive resistance means 130 on opposite ends of shaft 68 provides good balance and weight distribution.

Furthermore, the location of the load applying means 22 in front of the rear wheel of the bicycle most nearly simulates actual riding conditions and assures positive driving contact between a lower front portion of the rear wheel tire 79 and the driven friction wheel 77 at 164 in the direction of a radial line 166 intersecting a vertical line 168 through the rear wheel axis of rotation at an angle of less than 45° with the angle being reduced in accordance with the mounting height of the rear wheel as illustrated in FIG. 2. Various visual guages, such as a load indicator and/or a velocity indicator 170 may be suitably mounted on the exercise apparatus and connected to the variable load applying means 22 and/or the rear wheel of the bicycle to indicate load and/or speed.

While the inventive concepts have been hereinbefore described with respect to usage with a conventional bicycle mountable thereon, it is to be understood that certain of the novel features and advantages of the present invention may be utilized in a construction and arrangement involving a permanently mounted bicycle drive-type apparatus such as provided for conventional bicycle type exercising apparatus. Also, while the illustrative and presently preferred arrangement of the various load applying devices provide particularly desirable results, the devices may be modified and various combinations of such devices may be utilized as necessary or desirable. Thus, it is intended that the appended claims be construed to include alternative embodiments and modifications except insofar as limited by the prior art.

What is claimed is:

1. Exercising apparatus for simulating the characteristics of exercise during the actual riding of a bicycle comprising:

a self supporting unitary stationary frame means for mounting components of a bicycle or the like including at least a frame, a seat, handle bars and a front wheel fork, a rear wheel, crank arms and pedals, and a pedal operated drive system;

driven wheel means for frictionally engaging the rear wheel for rotation by the rear wheel to simulate engagement with the ground during the actual riding of a bicycle;

flywheel means operatively connected to said driven wheel means for energy storage during rotation of the rear wheel to simulate momentum during actual riding of a bicycle;

variable load applying means operatively connected to said driven wheel means for applying variable loads to said driven wheel means to simulate variations in load encountered during actual riding of a bicycle;

said self supporting unitary stationary frame means comprising:

lower support means for non-attachable self supporting placement on the ground or a floor for unitary support of the bicycle components and said driven wheel means and said flywheel means and said variable load applying means;

a front post means connected to and extending upwardly from the front end of said lower support means for supporting the bicycle front wheel fork;

a center post means connected to and extending upwardly from a central portion of said lower support means for supporting the bicycle frame adjacent the crank arms and the pedals;

rear support means connected to and extending upwardly from a rear portion of said lower support means for supporting said driven wheel means and said flywheel means and said variable load applying means, the rear wheel being supported only by said driven wheel means;

first mounting means associated with said front post means for attachment of the front wheel fork of a bicycle upon removal of the front wheel of the bicycle;

second mounting means associated with said center post means for engagement with a portion of the bicycle frame next adjacent the pedals and crank arms of the bicycle; and said driven wheel means and said flywheel means and said variable load applying means being located rearwardly of the crank arms and pedals in juxtaposition to the lowermost portion of the rear wheel.

2. The invention as defined in claim 1 and wherein said said variable load applying means comprising:

motion retarding means connected to said driven wheel means for variably applying a resistance load to said driven wheel means and being constructed and arranged to simulate ground resistance load applied to the rear wheel during actual riding of a bicycle on flat and variably inclined terrain.

3. The invention as defined in claim 2 and wherein said variable load applying means further comprising:

speed responsive load control means for automatically increasing and decreasing the load applied to said driven wheel means in accordance with the rotational speed of the rear wheel to simulate variations in wind resistance in actual riding of a bicycle.

4. The invention as defined in claim 3 and wherein said speed responsive load control means comprising:

a cage fan unit connected to and operable by said driven wheel means and being rotatable thereby.

5. The invention as defined in claim 3 and wherein said speed responsive load control means comprising:

a centrifugal control device operably connected to and operable by said driven wheel means and being operably connected to said motion retarding means for varying the load applied to said driven wheel means in accordance with the rotational velocity of the rear wheel.

6. The invention as defined in claims 1, 2, 3, 4 or 5 and wherein said rear support means comprising:

spaced vertically extending members located on opposite sides of said lower support means;

a shaft mounted between and rotatably supported by said members; and said driven wheel means and said flywheel means and said variable load applying means being mounted on said shaft.

7. The invention as defined in claims 1, 2, 3, 4, or 5 and further comprising:

a shaft member mounted on said rear support means and extending transversely to said lower support means and parallel to the rear wheel axle and being located forwardly thereof;

said driven wheel means being centrally mounted on said shaft member; and said flywheel means and said variable load applying means being mounted on opposite ends of said shaft member and being of substantially the same weight to provide counterbalancing weights for stabilization of said stationary frame means.

8. The invention as defined in claim 7 and wherein said lower support means consisting of:

a lowermost elongated tubular member located directly beneath the bicycle frame and having a length less than the length of the bicycle frame and having a lowermost elongated surface being non-attachably supportingly engageable with the ground or a floor; and a laterally extending stabilizer device mounted on said lowermost elongated tubular member and extending laterally outwardly therefrom on opposite sides thereof and being located between the rear wheel and the crank arms and pedals and generally beneath the seat of the bicycle.

9. The invention as defined in claim 8 and wherein:

said stabilizer member having spaced opposite forwardly extending end portions located in juxtaposition to and generally beneath the seat of the bicycle.

10. The invention as defined in claim 9 and wherein:

one of said end portions being located in juxtaposition to one end of said shaft member; and one of said end portions being located in juxtaposition to the opposite end of said shaft member.

11. The invention as defined in claims 6 or 7 and wherein:

the axis of rotation of said shaft member being located beneath the axis of rotation of the rear wheel in relatively close proximity to the lowermost portion of the rear wheel.

12. The invention as defined in claim 1 and further comprising:

adjustment means associated with said center post means for adjusting said center post means to accommodate bicycles of different sizes.

* * * * *